United States Patent [19]

Naganuma et al.

[11] Patent Number: 4,592,977

[45] Date of Patent: Jun. 3, 1986

[54] LITHOGRAPHIC PRINTING PLATE

[75] Inventors: Tsutomu Naganuma; Sigeru Hirayama; Hiroji Kumagai; Manabu Sawada; Tsuneo Tanaka; Isao Kumano, all of Tokyo, Japan

[73] Assignees: Toppan Printing Co., Ltd.; Toyo Ink Mfg. Co., Ltd., both of Japan

[21] Appl. No.: 622,226

[22] Filed: Jun. 19, 1984

[51] Int. Cl.[4] ..... G03G 5/06; G03G 5/087

[52] U.S. Cl. ..... 430/18; 430/49; 430/88; 430/89

[58] Field of Search ..... 430/18, 49, 78, 88, 430/89

[56] References Cited

U.S. PATENT DOCUMENTS 3,816,118 6/1974 Byrne ..... 430/78 X
4,076,528 2/1978 Bean et al. ..... 430/88

FOREIGN PATENT DOCUMENTS 639318 4/1962 Canada ..... 430/89
2054118 5/1972 Fed. Rep. of Germany ..... 430/88
53-74430 7/1978 Japan ..... 430/88

*Primary Examiner*—Roland E. Martin
*Attorney, Agent, or Firm*—Lerner, David, Littenberg, Krumholz & Mentlik

[57] ABSTRACT

The present invention relates to a lithographic printing plate which can eliminate disadvantages of conventional zinc oxide master papers and has sensitivity sufficient for practical use in respect of long wavelength laser light. The invention contemplates to provide the lithographic printing plate which is fabricated by charging an electrophotographic plate involving a photoconductive layer on a conductive substrate, the photoconductive layer being prepared by dispersing a mixture containing 50 wt % or less of a phthalocyanine pigment/(zinc oxide and zinc sulfide) into a binder resin, exposing the electrophotographic plate to an image to form the electrostatic latent image, developing the exposed electrophotographic plate by the use of an ink receptive toner, and fixing the plate thus developed.

4 Claims, 4 Drawing Figures

LITHOGRAPHIC PRINTING PLATE

BACKGROUND OF THE INVENTION (1) Field of the Invention

This invention relates to a lithographic printing plate fabricated by writing information on a highly sensitive photoconductive material for a short period of time, and said photoconductive material involving a binder resin into which a phthalocyanine pigment, zinc oxide and zink sulfide are dispersed.

(2) Description of the Prior Art

With rationalization of office work, word processors have recently spread. In this connection, a conventional typewriter types out characters on papers one by one, whereas a word processor stores once inputted characters in the memory as electrical signals and at the same time, reads out such electrical signals to display them in the cathode-ray tube as the characters.

On the other hand, in order to fabricate a printing plate on the basis of the electrical signals which had been stored in the memory of a word processor, characters have been once outputted on papers as the hard copy in accordance with ink jet printing, heat sensitive recording, wire-dot recording, electrophotographic or the like method, and a zinc oxide master recording paper is charged, exposed and fixed by using the hard copy as an original material, whereby the printing plate is obtained. However, such process as described above requires much work and time because there are two steps of outputting for the hard copy and of plate making. The process has also such disadvantage that quality of the image in a printing plate deteriorates since the image must be copies on the printing plate from the hard copy. Furthermore there is a process in which image is directly exposed on a photoconductive plate by means of laser light to form latent image, and then the latent image is developed and fixed, whereby a printing plate is fabricated. In this process, argon, helium-neon, helium-cadmium YAG, carbonic acid gas or the like laser is utilized. There are, however, such disadvantages that these lasers become oversized in order to obtain a required output, and power consumption thereof is too remarkable for the amount of light outputted. In this respect, comparing semiconductor laser with those described above, the semiconductor laser has such characteristic features of favourable microminiaturization, high efficiency, low voltage, low power consumption, being capable of effecting high speed modulation over 1 GHz by means of driving electric power, high reliability peculiar to semiconductor and the like. However, semiconductor laser, such as AlGaAs laser light of a semiconductor laser which is put to practical use is 760~800 nm or 820~880 nm, has a small amount of outputted light and a wavelength outputted is longer in comparison with gas laser light. In this connection, there is such a fatal disadvantage that zinc oxide master paper which has heretofore been used in this technical field has no sensitivity with respect to long wavelength laser light. As photoconductive materials having sensitivity with respect to such long wavelength, CdS-Cu, Se-Te/Se, amorphous silicon, phthalocyanine pigments and the like are known, but only the phthalocyanine pigments can be put to practical use in view of toxicity and cost. However, since phthalocyanine pigments have such small average particle diameter of 0.05$\mu$ and are electrically low resistant, it is required that a ratio of components of a binder resin makes higher in order to utilize any phthalocyanine pigment in an electrophotographic plate prepared by dispersing such phthalocyanine pigment into the binder resin. In this connection, when prepared an electrophotographic plate from only a phthalocyanine pigment and a binder resin, the surface of the resulting electrophotographic plate becomes very smooth so that fixation of toner is very unfavourable. For this reason, there is such a disadvantage that even though a lithographic printing plate was fabricated from the electrophotographic plate, such toner separates from the electrophotographic plate during printing operation and accordingly, such electrophotographic plate could not have been utilized.

The present invention contemplates to eliminate disadvantages of said phthalocyanine electrophotographic plate and for which tests were conducted by mixing fillers which mat the surface of electrophotographic plate with a binder resin and a phthalocyanine pigment for improving fixation of toner and hydrophilic property of the electrophotographic plate when employed as a lithographic printing plate. As a result of the tests through selecting titanium oxide, calcium carbonate, cadmium carbonate, magnesium oxide, zinc oxide, or zinc sulfide as a filler, it was found that while matted surface of the resulting electrophotographic plate was attained, photosensitivity fell much more than, dark decay became larger than, and charge retentivity became also inferior to those of an electrophotographic plate composed of phthalocyanine pigment-resin. On one hand, it was also found that an electrophotographic plate prepared by dispersing phthalocyanine pigment and zinc oxide and zinc sulfide into a binder resin could form minute unevenness on the surface of the resulting photoconductive layer by means of zinc oxide and zinc sulfide without decreasing photosensitivity thereof, because of a larger average particle diameter of 0.3$\mu$ in zinc oxide and zinc sulfide than that of phthalocyanine pigment, of a high value of electric resistance of said electrophotographic plate, and of such fact that a ratio of components in the binder resin can be reduced in case of a phthalocyanine pigment alone, and thus zinc oxide and zinc sulfide were desirable for the fillers to be contained in the electrophotographic plate used in the present invention.

In phthalocyanine pigment-resin electrophotographic plates, since the phthalocyanine pigment pertains principally to photosensitivity, electrophotographic characteristics in positive charge are favourable. However, the present inventors have obtained such novel knowledge that an electrophotographic plate to a photoconductive layer of which has been added only zinc oxide as the filler has poor charge retentivity and poor dark decay property with respect to positive charge, whilst an electrophotographic plate comprising only zinc sulfide as the filler has such disadvantage that although there are good charge retentivity and good dark decay property with respect to positive charge, residual potential becomes remarkable.

SUMMARY OF THE INVENTION

The present invention relates to a lithographic printing plate which can eliminate disadvantages of conventional zinc oxide master paper on the basis of the above-mentioned knowledge, and the invention contemplates to provide the lithographic printing plate which is fabricated by charging an electrophotographic plate involving a photoconductive layer on a conductive substrate, said photoconductive layer being prepared by dispersing a mixture containing 50 wt % or less of a phthalocyanine pigment/(zinc oxide and zinc sulfie) into a binder resin, exposing said electrophotographic plate to an image to form the electrostatic latent image, developing the exposed electrophotographic plate by the use of an ink receptive toner, and fixing the toner thus developed.

DESCRIPTION OF THE PREFERRED EMBODIMENTS

Figure 1:
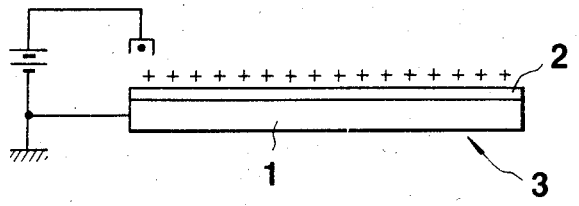
FIG. 1 is an explanatory view illustrating a state wherein a phthalocyanine pigment-(zinc oxide+Zinc sulfide) electrophotographic plate is charged with corona discharge.
Figure 2:
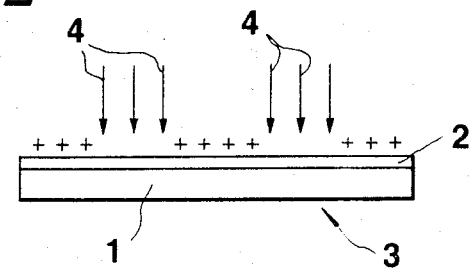
FIG. 2 is an explanatory view illustrating a state wherein the electrophotographic plate is exposed to an image with light to form the electrostatic latent image.
Figure 3:
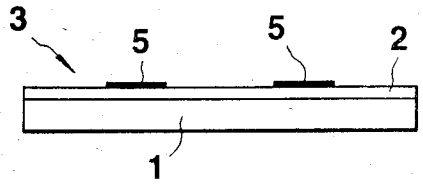
FIG. 3 is an explanatory view showing the electrophotographic plate developed by the use of a positive charged ink receptive toner.
Figure 4:
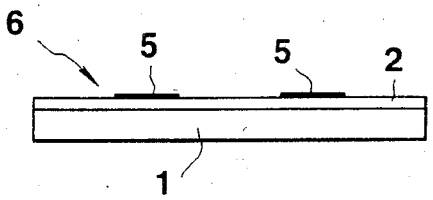
FIG. 4 is an explanatory view showing a lithographic printing plate obtained after the toner was fixed.

The present invention will be described in detail hereinbelow by referring to the accompanying drawings wherein first, an electrophotographic plate 3 is formed by applying a photoconductive layer 2 prepared by dispersing a mixture of a phthalocyanine pigment and a higher weight ratio than that of said pigment of zinc oxide and zinc sulfide into a binder resin on a conductive substrate 1 as shown in FIG. 1. Then, the surface of the electrophotographic plate 3 is charged by means of corona discharge or the like by employing a charging means. Thereafter the electrophotographic plate charged is exposed to an image with semiconductor laser light 4 modulated by an electrical signal (for example, semiconductor laser light modulated by means of the electrical signal read out by a memory in a word processor) to form the electrostatic latent image as shown in FIG. 2. The exposed electrophotographic plate is developed by means of an ink receptive toner 5 which has been charged positively as shown in FIG. 3, and the material thus developed is then fixed as shown in FIG. 4, whereby a lithographic printing plate 6 is fabricated.

Examples of the conductive substrate used in the present invention include; materials prepared by subjecting a metallic plate or sheet made of metal such as aluminum, brass, copper or stainless steel, or a plastic sheet to vacuum deposition by the use of aluminum, chromium, palladium, metallic oxides or the like; materials prepared by giving conductivity to a plastic plate, paper or the like; plates or sheets etc. made of metallic oxides.

Phthalocyanines used in the present invention may be classified into metal-free phthalocyanines and metal-phthalocynines, and metal-free phthalocyanines are known to have various crystal forms such as of $\alpha$, $\beta$, X and the like, whereas metal-phthalocyanines include copper, aluminum, vanadium and the like phthalocynines. Particularly, copper phthalocyanine is known to have also various crystal forms such as of $\alpha$, $\beta$, $\epsilon$ and the like. In case of conducting image exposure with laser light being an embodiment of the present invention, it is required to select a phthalocyanine having sensitivity with respect to light of a long wavelength (790–800 nm). For this purpose, it is preferable to use metal-free phthalocyanines, copper phthalocyanine of $\epsilon$ form, or phthalocyanine derivatives wherein the benzene nucleus of the phthalocyanine molecule is substituted with nitro or cyano groups as a part of the components of a photoconductive material (refer to U.S. Pat. No. 4,443,528).

As zinc oxide utilized for a filler in the present invention, any of which is powdery and is commonly employed for electrophotography may be used, whilst ordinary reagent grade of zinc sulfide may be used for the present invention and which is inexpensive and nontoxic.

In the present invention, zinc oxide/(a phthalocyanine pigment+zinc oxide+zinc sulfide+a binder resin) are within a range of 20–60 wt %, and preferably 35–50 wt %. When zinc oxide is excessive, electrophotographic properties deteriorate, whilst hydrophilic nature decreases in case of too deficient zinc oxide. Furthermore favorable results were obtained in the case where a ratio of blending phthalocyanine pigment with (zinc oxide+zinc sulfide) is 20–45 wt % and zinc sulfide/zinc oxide are in a ratio of 10–50 wt %. This is because photosensitivity with respect to semiconductor laser light is deficient in the case where phthalocyanine pigment is less than 20 wt %, whereas when exceeded 45 wt %, fixation of an ink receptive toner as well as wetting thereof with respect to water become unfavourable. Of course, the above described fact is significantly influenced by loadings of a binder resin. As to a binder ratio, favourable results were obtained in the case where binder resin/phthalocyanine pigment=1.5—4 (weight ratio) in view of film performance, charge retentivity, and wetting to water.

Synthetic resins used for binder resin include known thermoplastic resins such as polyester, polystyrene, polyvinyl chloride, polyvinyl acetate, vinyl chloridevinyl acetate copolymer, polyvinyl acetal, polyvinyl butyral, alkyd resin, acrylic resin, polyacrylonitrile, polycarbonate, polyketone and the like as well as known thermosetting resins such as polyurethane and epoxy resin. In this respect, particularly favourable resins involving hydrophilic groups include polyvinyl alcohol, polyvinyl pyrrolidone, polyamide, polyacrylamide, polyvinyl acetate, polyvinyl formal, polyvinyl butyral, phenol resin and the like.

Solvents used in case of preparing the electrophotographic plate in the present invention include aromatic hydrocarbons such as benzene, toluene, xylene, chlorobenzene and the like, ketones such as acetone, methyl ethyl ketone, cyclohexanone and the like, alcohols such as methanol, ethanol, isopropanol and the like, esters such as ethyl acetate, Methyl Cellosolve and the like, halogenated hydrocarbons such as carbon tetrachloride, chloroform, dichloromethane and the like, ethers such as tetrahydrofuran, dioxane and the like as well as dimethylformamide, dimethyl sulfoxide and the like.

There are various manufacturing processes of the electrophotographic plate utilized in the present invention, one example of which is conducted in such a way that a phthalocyanine pigment, a binder resin and a solvent are dispersed by means of a ball mill, to the mixture is then added zinc oxide and zinc sulfide powder, they are further dispersed, the resulting photoconductive composition is applied on a conductive substrate, and the substrate thus applied is dried. As the method for dispersion, any known method may be practiced, for example, paint conditioner, ultrasonic dispersing and the like methods are applicable other than the abovementioned ball mill method. Further as the coating method, a method wherein applicator, spray coater, bar coater, dip coater, doctor blade coater or the like is utilized is applicable, and these methods are properly used dependent upon viscosity, solvent, and amount of coating.

The above described electrophotographic plate can be exposed with not only visible light of 400–700 nm, but also infrared light of over 700 nm so that a conventional ordinary exposing method and light source may be used in the present invention. The most suitable exposing method is one wherein the electrophotographic plate is directly exposed with semiconductor laser light modulated by electrical signal, if such facts that photosensitivity of the present electrophotographic plate is extremely high as compared with that of conventional plate, that a sensitive wave range is 700 nm or more, and that electrical signal can directly be taken out from word processor are taken into consideration.

An ink receptive toner is selectively formed on an electrostatic latent image formed by means of image exposure upon an electrophotographic plate to form the toner image, and the resulting toner image is then heated to effect fixation. In the lithographic printing plates thus obtained, one wherein dampening water is utilized involves unevenness on the surface of the electrophotographic plate, so that fixation can be easily carried out by heating.

Ink receptive toner includes dry toner and wet toner, and either toner may be employed.

An ink receptive toner for dry developing is composed of a charge controller such as an electron receptive organic complex, a colorant such as carbon black, and a suitable resin. In two-component system, such ink receptive toner is utilized by mixing with a carrier such as iron powder, whereas no carrier is required in a single-component system so that a toner composed of magnetite, a charge controller, a colorant such as carbon black, and a suitable resin is usually employed.

As an ink receptive toner for wet developing, one prepared by dispersing coabon black, a resin, a charge controller and the like into any of isoparaffin petroleum solvents is desirably used.

As a resin for ink receptive toners, it is required that such resin has high insulating properties and a comparatively low mocleular weight, and that either such resin combines chemically with a photoconductive layer at the time of thermal fixation, or such resin is compatible with a dispersing resin in the photoconductive layer. After fixation, since a printing ink adheres to the ink receptive toner, a resin accepted to the ink composition is particularly preferable, and resins suitable for this purpose include phenol resin, polyester resin, copolymer of styrene and maleic anhydride, polyamide resin, drying oil alkyd and the like.

The present invention will be more fully described by way of the following exmaples.

EXAMPLE 1

A semiconductor laser beam printer LBP-10 manufactured by Canon Co., Ltd. was reorganized as follows. First, a floppy disk reader and an interface circuit were attached to the input side so that it made possible that electrical signal of characters or the like which had been inputted through a keyboard and stored in the floppy disk is read out and put into the LBP-10. Furthermore a photosensitive drum was replaced by an aluminum drum, at the same time, grooves were defined on the aluminum drum, and two hooks were mounted on the grooves. An electrophotographic plate was wound around the drum in such that before and behind the plate could be secured by means of these hooks. Further, in the printer, a positively charging means and a liquid developing means were adjusted to be only functional.

Thereafter 80 g of copper phthalocyanine and 1.0 g of tetranitro copper phthalocyanine were dissolved into 1,000 g of 98% sulfuric acid while sufficiently agitating them. The dissolved liquid was admixed with 10 l of water to separate out a composition of copper phthalocyanine and tetranitro copper phthalocyanine, then the composition was filtered, washed with water, and dried at 120° under reduced pressure. 50 g of the composition (A) thus obtained was blended with 50 g of $\epsilon$ from copper phthalocyanine (Lionol Blue ER manufactured by Toyo Ink Mfg. Co., Ltd.), and the mixture was dispersed into 5 kg of methanol to obtain a homogeneous mixed dispersion. Thereafter the dispersion was filtered, and dried at 120° C. under reduced pressure to prepare a mixed composition (B).

In accordance with the following formulation, a photoconductive composition was prepared.

| | |
|---|---|
| Mixed Composition (B) | 10 g |
| Silicone Resin (KR-211, trade name, manufactured by Shinetsu Chemical Industry Co., Ltd., solid content: 70 wt %) | 33.4 g |
| Acrylic Resin (Aron S 1001, trade name, manufactured by Toa Gosei Chemical Industry Co., Ltd., solid content: 50 wt %) | 5.2 g |
| Toluene | 101.4 g |

The above compositions were dispersed by means of a porcelain ball mill for 48 hours, then, to the dispersion obtained were added 30 g of photoconductive zinc oxide (SAZEX 2000, trade name, manufactured by Sakai Chemical Industry Co., Ltd.) and 3.3 g of reagent zinc sulfide (manufactured by Kanto Chemical Industry Co., Ltd.), and the mixture was further dispersed in the ball mill for 6 hours. Then, the resulting mixed liquor was again diluted with toluene to reduce the viscosity thereof, the diluted liquor was roll coated on a laminated aluminum foil composed of an aluminum foil having a thickness of 15$\mu$ and a polyester film of 75$\mu$ so as to have a dry film thickness of 8$\mu$, and the coated foil was dired at 50° C. for 8 hours thereby obtaining an electrophotographic plate for electrophotography. The electrophotographic plate sample thus obtained was subjected to corona discharge in +5.7 KV, with a corona gap of 10 mm and at a charging speed of 10 m/min., and in this case, the potential at 1.0 second after ceasing the discharge was defined as "initial surface potential" and "photosensitivity" was similarly defined in such that the sample was exposed with monochromatic light of 800 nm in an intensity of light of 2 $\mu W/cm^2$ at 1.0 second after the discharge, and an amount ($\mu J/cm^2$) of light energy required for reducing the initial surface potential by 50% was considered to be the sensitivity. Further a half-life period of initial surface potential in dark room was defined as "dark decay time" (sec.).

The characteristic properties of samples thus measured were as indicated in the column of Example 1 of the following Table 1, and the sensitivity thereof exhibited a satisfactory value.

The resulting electrophotographic plate was mounted on the hooks in the laser printer and at the same time, said aluminum drum was grounded. Then, electrical signal was put into the laser printer from the floppy disk reader to operate the printer, the electrophotographic plate was exposed to an image by means of a semiconductor laser after charging the material, and then the exposed plate was reversedly developed in accordance with liquid developing method by the use of a liquid developer IP-2 Set (positive type ink receptive toner) manufactured by Iwasaki Tsushinki Co., Ltd. Thereafter, the resulting electrophotographic plate was removed from the aluminum drum, whereby a lithographic printing plate was fabricated.

Then, the surface of the printing plate was damped with a damping aqueous solution containing gum arabic and phosphoric acid, the damped printing plate was dired, then the printing plate was applied to the printing drum of an offset printing machine 2800 CD manufactured by Ryobi Co. by means of a doublecoated adhesive type. In this offset printing machine, printing was conducted on wood free papers under a printing pressure of 0.30 mm by employing offset process ink G set (jetblack) manufactured by Toyo Ink Mfg. Co., Ltd. and dampening water (4000 revolutions/hour). In starting the printing, printed matters were lighter in color, but the density in its solid portion was also improved to 1.4 or more, when exceeded 30 pieces of printed matters so that favourable printed matters were obtained (a total of 10,000 papers was printed).

Furthermore background exposure was effected by reversing ON-OFF relationship of electrical signal in the laser printer, the laser printer was operated by means of the floppy disk reader, the resulting electrophotographic plate was (positively) charged, the charged plate was then subjected to non-image portion exposure by means of a semiconductor laser, and thereafter the electrophotographic plate thus exposed was normally developed in accordance with liquid developing method by using a liquid developer Lithoset SN 7037A (negative type ink receptive toner) manufactured by Hunt Co. Then, the electrophotographic plate was removed from the aluminum drum, whereby a lithographic printing plate was obtained.

The resulting printing plate was processed by the same manner as that mentioned above, and the processed printing plate was attached to the offset printing machine. In printing, the same favourable printed matters as those of the above case were obtained.

TABLE 1

| Example No. | 1 | 2 | 3 | 4 |
|---|---|---|---|---|
| Initial Surface Potential (V) | 550 | 410 | 410 | 520 |
| Dark Decay Time (sec.) | 14.8 | 14.4 | 10.2 | 20.4 |
| Photosensitivity ($\mu J/cm^2$) | 2.2 | 3.6 | 2.7 | 3.4 |

EXAMPLES 2–4

The electrophotographic plate prepared by the same manner as that of Example 1 except that the pigments enumerated in Table 2 were utilized as a phthalocyanine pigment and 20 g of polyvinyl butyral (S-lec-BLS, trade name, manufactured by Sekisui Chemical Industry Co., Ltd.) was used as the resin had characteristic properties as indicated in Table 1. Any of lithographic printing plates fabricated from the electrophotographic plates as described above was excellent as in the case of Example 1.

TABLE 2

| Example | Phthalocyanine Pigment |
|---|---|
| 2 | $\epsilon$ form copper phthalocyanine (Heliogen Blue L-6700F, trade name, manufactured by BASF A.G.) |
| 3 | $\alpha$ form metal-free phthalocyanine (Heliogen Blue L-7560, trade name, manufactured by BASF A.G.) |
| 4 | Phthalocyanine composition (A) in Example 1 |

EXAMPLE 5

By exmploying the same phthalocyanine composition (A) as that of Example 1, a photoconductive composition was prepared in accordance with the following formulation:

| | |
|---|---|
| Composition (A) | 15 g |
| Silicone Resin (KR-211 manufactured by Shinetsu Chemical Industry Co., Ltd., solid content: 70 wt %) | 7.5 g (Solid: 5.25 g) |
| Butyral Resin (S-lec-BLS manufactured by Sekisui Chemical Co., Ltd.) | 21 g |
| Methyl Alcohol | 116 g |
| Methyl Ethyl Ketone | 65 g |
| Cellosolve Acetate | 65 g |

The above compositions were dispersed in a porcelain ball mill for 48 hours, to the dispersion obtained were then added 45 g of photoconductive zinc oxide (SAZEX 2000 manufactured by Saki Chemical Industry Co., Ltd.) and 5 g of reagent zinc sulfide (manufactured by Kanto Chemical Industry Co., Ltd.), and the mixture was further dispersed in the ball mill for 6 hours. Then, the resulting mixed liquor was roll coated on a laminated aluminum foil composed of an aluminum foil having a thickness of 15 $\mu m$ and a polyester film of 75 $\mu m$ so as to have a dry film thickness of 12 $\mu m$, and the coated foil was dried at 100° C. for 5 minutes thereby to obtain an electrophotographic plate for electrophotography.

With respect to the sample thus obtained, electrophotographic properties were measured in accordance with the same manner as that of Example 1, and the results thereof are indicated in Table 3.

TABLE 3

| | Example No. | | Comparative Example No. | | | | | |
|---|---|---|---|---|---|---|---|---|
| | 5 | 6 | 1 | 2 | 3 | 4 | 5 | 6 |
| Initial surface Potential (V) | 500 | 600 | 300 | 350 | 200 | 350 | 860 | 700 |
| Dark Decay Time (sec.) | 17.0 | 10.0 | 4.6 | 3.8 | 1.9 | 11.4 | 13.0 | 5.4 |
| Photosensitivity ($\mu J/cm^2$) | 3.0 | 3.0 | 8.8 | 10.0 | 8.0 | 3.2 | 4.0 | 3.6 |

EXAMPLE 6 AND COMPARATIVE EXAMPLES 1–6

The electrophotographic plates prepared by the same manner as that of Example 5 except that amounts of fillers of zinc oxide and zinc sulfide as well as type of fillers were varied in accordance with data enumerated in Table 4 had characteristic properties as indicated in Table 3. As is apparent from Table 3, any of Comparative Examples was inferior to Example of the present invention in their electrophotographic characteristics.

TABLE 4

| | Example No. | | Comparative Example No. | | | | | |
|---|---|---|---|---|---|---|---|---|
| Filler | 5 | 6 | 1 | 2 | 3 | 4 | 5 | 6 |
| ZnO | 45 | 35 | — | — | — | 50 | 25 | 15 |
| ZnS | 5 | 15 | — | — | — | — | 25 | 35 |
| $TiO_2$ | — | — | 50 | — | — | — | — | — |
| $CdCO_3$ | — | — | — | 50 | — | — | — | — |
| $CaCO_3$ | — | — | — | — | 50 | — | — | — |

Since the present invention is constructed as described above, an electrophotographic plate can directly be exposed to image by means of, for example, the memory of a word processor to obtain printing plates without once making the hard copy on papers. Thus processing period of time becomes shortened, and exposure time is also reduced because of high sensitivity of the electrophotographic plate, besides a printing plate can be fabricated without deteriorating quality of image so that printed matters of high quality can be obtained by the present invention.

What is claimed is:

1. A lithographic printing plate comprising an electrophotographic plate having a photoconductive layer on a conductive substrate, said photconductive layer being prepared by dispersing a mixture containing from about 20–45% by weight of a phthalocyanine pigment to the amount of photoconductive zinc oxide and zinc sulfide into a binder resin, said photoconductive zinc oxide being 20–60% by weight of a mixture of said phthalocyanine pigment, zinc oxide, zinc sulfide, and binder resin, said electrophotographic plate being charged, an electrostatic latent image formed when said charged electrophotographic plate is exposed to an image, the exposed electrophotographic plate being developed by the use of an ink receptive toner for developing said exposed electrophotographic plate, and the developed electrophotographic plate being fixed thereby to fabricate said lithographic printing plate.

2. A lithographic printing plate as claimed in claim 1 wherein said ratio of zinc oxide to mixture of said phthalocyanine pigment, zinc oxide, zinc sulfide, and binder resin is within a range of 35–50 wt %.

3. A lithographic printing plate as claimed in claim 1 or 2 wherein said zinc sulfide/zinc oxide are in a ratio of 10–50 wt %.

4. A lithographic printing plate as claimed in claim 1, 2 or 3 wherein said image exposure is conducted with semiconductor laser light modulated by electrical signal.

* * * * *